US009062453B1

(12) United States Patent
Maziarz

(10) Patent No.: US 9,062,453 B1
(45) Date of Patent: Jun. 23, 2015

(54) EXPANSION/CONTROL JOINT FOR STUCCO SURFACES

(71) Applicant: E-Z BEAD LLC, Royersford, PA (US)

(72) Inventor: Jeffrey Maziarz, Royersford, PA (US)

(73) Assignee: E-Z BEAD LLC, Royersford, PA (US)

( * ) Notice: Subject to any disclaimer, the term of this patent is extended or adjusted under 35 U.S.C. 154(b) by 0 days.

(21) Appl. No.: 13/839,846

(22) Filed: Mar. 15, 2013

(51) Int. Cl.
*E04B 1/68* (2006.01)

(52) U.S. Cl.
CPC ..... *E04B 1/6815* (2013.01); *E04B 1/68* (2013.01); *E04B 1/6813* (2013.01)

(58) Field of Classification Search
CPC ..... E04B 1/68; E04B 1/6803; E04B 1/6807; E04B 1/6813; E04B 1/6815
USPC ..... 52/396.04, 396.08, 396.1, 214, 396.05, 52/396.06, 396.02, 396.03
See application file for complete search history.

(56) References Cited

U.S. PATENT DOCUMENTS

| | | | | | |
|---|---|---|---|---|---|
| 517,701 | A | * | 4/1894 | Knower | 52/393 |
| 1,030,044 | A | | 6/1912 | Whittbecker | |
| 1,361,843 | A | | 12/1920 | Flagge | |
| 1,386,509 | A | | 8/1921 | Kirmes et al. | |
| 1,673,971 | A | | 6/1928 | John | |
| 1,679,914 | A | | 8/1928 | Murray | |
| 1,840,221 | A | | 1/1932 | Bridges | |
| 1,886,320 | A | | 11/1932 | Waite | |
| 1,956,809 | A | | 5/1934 | Robertson | |
| 2,031,249 | A | | 2/1936 | Bowman | |
| 2,151,605 | A | | 3/1939 | Lavering | |
| 2,189,216 | A | | 2/1940 | Mathias | |
| 2,198,084 | A | | 4/1940 | Jacobson | |
| 2,272,162 | A | | 2/1942 | Lackey | |
| 2,286,890 | A | | 6/1942 | Birt | |
| 2,405,844 | A | * | 8/1946 | Mortenson | 404/69 |
| 2,725,608 | A | | 12/1955 | Parslow | |
| 2,732,045 | A | | 1/1956 | Herlocker | |
| 2,742,120 | A | | 4/1956 | Rosebrook | |
| 2,845,666 | A | | 8/1958 | Knapp | |
| RE24,658 | E | | 6/1959 | Hollister | |

(Continued)

FOREIGN PATENT DOCUMENTS

| | | |
|---|---|---|
| DE | 2455775 | 8/1976 |
| DE | 2538412 | 3/1977 |

(Continued)

*Primary Examiner* — Phi A
(74) *Attorney, Agent, or Firm* — John F. A. Earley, III; Frank J. Bonini, Jr.; Harding, Earley, Follmer & Frailey, P.C.

(57) ABSTRACT

An expansion/control joint, used to separate stucco or plaster material into sub-portions during application of the stucco or plaster material to a wall, and to relieve stress and limit or control cracking in a stucco or plaster wall or surface caused by stucco or plaster shrinkage and thermal movement in the stucco or plaster wall or surface, includes an expansion/contraction member comprising two flexible panels extending between second sides of first and second stucco stop walls, the two panels comprising an upper panel and a lower panel, the panels forming in conjunction with the second sides of the first and second stucco stop walls a flexible hollow tube which extends along and between the second sides of the first and second stucco stop walls and which flexes to accommodate expansion and contraction of the stucco or plaster material responsive to weather induced movement of the stucco or plaster material.

9 Claims, 4 Drawing Sheets

(56) References Cited

U.S. PATENT DOCUMENTS

| | | | | | |
|---|---|---|---|---|---|
| 2,904,992 | A | | 9/1959 | Cruser | |
| 2,953,835 | A | | 9/1960 | Armstrong et al. | |
| 3,192,577 | A | | 7/1965 | Thomas | |
| 3,201,908 | A | | 8/1965 | Arnold | |
| 3,213,577 | A | | 10/1965 | Levin | |
| 3,319,384 | A | | 5/1967 | Berg | |
| 3,349,519 | A | | 10/1967 | Nehlig | |
| 3,398,494 | A | | 8/1968 | Larson | |
| 3,512,318 | A | | 5/1970 | Turner | |
| 3,608,254 | A | | 9/1971 | Sklamberg et al. | |
| 3,619,944 | A | | 11/1971 | Matvey | |
| 3,667,174 | A | | 6/1972 | Arnett | |
| 3,765,138 | A | | 10/1973 | Bentle | |
| 3,782,680 | A | | 1/1974 | Hopkins | |
| 3,813,180 | A | * | 5/1974 | O'Brill | 404/48 |
| 3,849,958 | A | | 11/1974 | Balzer | |
| 3,871,787 | A | * | 3/1975 | Stegmeier | 404/48 |
| 3,922,826 | A | | 12/1975 | Molyneux | |
| 3,964,220 | A | | 6/1976 | Rutkowski et al. | |
| 4,038,791 | A | | 8/1977 | Atkinson | |
| 4,505,079 | A | | 3/1985 | Black | |
| 4,545,162 | A | | 10/1985 | Attaway | |
| 4,651,488 | A | * | 3/1987 | Nicholas et al. | 52/396.02 |
| 4,663,883 | A | | 5/1987 | Hilliard et al. | |
| 4,726,148 | A | | 2/1988 | Ti | |
| 4,763,455 | A | | 8/1988 | Schneller | |
| 4,774,795 | A | | 10/1988 | Braun | |
| 4,781,004 | A | * | 11/1988 | Hartman | 52/464 |
| 4,784,516 | A | * | 11/1988 | Cox | 404/69 |
| 4,785,601 | A | | 11/1988 | Tupman | |
| 4,829,731 | A | | 5/1989 | Schluter | |
| 4,841,704 | A | * | 6/1989 | Jarrell | 52/396.02 |
| 5,014,471 | A | | 5/1991 | Ballstadt | |
| 5,042,211 | A | | 8/1991 | Nestler | |
| 5,073,430 | A | | 12/1991 | Aidan | |
| 5,127,204 | A | | 7/1992 | Braun | |
| 5,181,357 | A | | 1/1993 | Pourtau et al. | |
| 5,210,986 | A | | 5/1993 | Hagemeyer et al. | |
| 5,222,343 | A | | 6/1993 | Anderson | |
| 5,230,738 | A | | 7/1993 | Wheeler | |
| 5,305,566 | A | | 4/1994 | Larkowski | |
| 3,486,283 | A | | 5/1994 | Arnett | |
| 5,313,755 | A | | 5/1994 | Koenig, Jr. | |
| 5,333,432 | A | | 8/1994 | Schluter | |
| 5,338,130 | A | | 8/1994 | Baerveldt | |
| 5,423,154 | A | | 6/1995 | Maylon et al. | |
| 5,430,981 | A | | 7/1995 | Scott | |
| 5,450,699 | A | * | 9/1995 | Lee | 52/396.02 |
| D364,233 | S | | 11/1995 | Caley | |
| 5,544,445 | A | | 8/1996 | Mantilla | |
| 5,551,201 | A | | 9/1996 | Anderson | |
| 5,579,623 | A | | 12/1996 | Stark et al. | |
| 5,607,253 | A | | 3/1997 | Almstrom | |
| 5,671,571 | A | | 9/1997 | Braun | |
| 5,699,638 | A | | 12/1997 | Maylon | |
| 5,761,866 | A | | 6/1998 | Maylon | |
| 5,791,116 | A | | 8/1998 | Skintzis | |
| 5,950,370 | A | | 9/1999 | Peck | |
| 5,970,671 | A | | 10/1999 | Bifano et al. | |
| 6,018,924 | A | | 2/2000 | Tamlyn | |
| 6,102,407 | A | | 8/2000 | Moriya et al. | |
| 6,119,416 | A | | 9/2000 | Larson | |
| 6,122,883 | A | | 9/2000 | Braun | |
| 6,223,486 | B1 | | 5/2001 | Dunham | |
| 6,298,609 | B1 | | 10/2001 | Bifano et al. | |
| 6,308,475 | B1 | | 10/2001 | Crish, II et al. | |
| 6,322,045 | B1 | | 11/2001 | Andros | |
| 6,338,229 | B1 | | 1/2002 | Botzen | |
| D456,528 | S | | 4/2002 | Maylon et al. | |
| 6,367,210 | B1 | | 4/2002 | Trundle | |
| 6,425,216 | B1 | | 7/2002 | Gardner | |
| 6,490,831 | B1 | | 12/2002 | Candusso | |
| D471,991 | S | | 3/2003 | Maylon et al. | |
| 6,631,595 | B1 | | 10/2003 | Minter | |
| 6,705,047 | B2 | | 3/2004 | Yulkowski | |
| 7,406,805 | B1 | | 8/2008 | Larson | |
| 7,458,190 | B2 | * | 12/2008 | Isaac et al. | 52/396.03 |
| 7,526,897 | B2 | | 5/2009 | Collins | |
| 7,634,883 | B1 | | 12/2009 | Larson et al. | |
| 7,874,123 | B2 | | 1/2011 | Maziarz | |
| 8,132,380 | B2 | * | 3/2012 | Wilkes, Jr. | 52/396.04 |
| 8,615,944 | B2 | | 12/2013 | Maziarz | |
| 2002/0124504 | A1 | * | 9/2002 | Maylon et al. | 52/318 |
| 2003/0051422 | A1 | | 3/2003 | Maziarz | |
| 2004/0020143 | A1 | | 2/2004 | Webb | |

FOREIGN PATENT DOCUMENTS

| | | |
|---|---|---|
| DE | 3503395 | 8/1986 |
| FR | 2307091 | 11/1976 |
| FR | 2412236 | 7/1979 |
| FR | 2507227 | 12/1982 |
| SU | 1705521 | 1/1992 |

* cited by examiner

EXPANSION/CONTROL JOINT FOR STUCCO SURFACES

BACKGROUND OF THE INVENTION

1. Field of the Invention

This invention relates to the application of stucco or plaster in homes or other buildings and specifically to an expansion/control joint used to relieve stress and limit or control cracking in a stucco or plaster wall or surface caused by stucco or plaster shrinkage and thermal movement in the stucco or plaster wall or surface.

2. Background of the Prior Art

Stucco and/or plaster are typically used for both interior and exterior surfaces in home or commercial building construction. Stucco or plaster is routinely applied to a galvanized wire mesh over felt paper which has been attached to underlying plywood or other sheathing material. (See FIG. 1.) In order to relieve stress and limit or control cracking in a stucco or plaster surface, expansion/control joints are typically provided in the stucco or plaster surface every 144 square feet of stucco or plaster surface.

An expansion/control joint often used for this purpose comprises two plaster stops (that is, a first plaster stop and a second plaster stop), each generally comprising a perforated plastic strip approximately 2 inches wide with a plaster lip or edge acting to contain the stucco or plaster. The first plaster stop is typically installed approximately ¼ inch away from the second plaster stop with the back of the plaster lip of the first plaster stop facing the back of the plaster lip of the second plaster stop, leaving a gap between the back of the plaster lip of the first plaster stop and the back of the plaster lip of the second plaster stop. In order to provide a complete finish, a worker must install a backer rod into the gap and then apply a finishing layer of caulk in the gap and over the backer rod. This process, which is used by some builders to prevent leaks, is very time consuming.

This method of stucco installation has often resulted in leaking problems between adjacent stucco or plaster surfaces, thereby causing significant additional repair costs and frustration to both home owners and construction companies. In addition, the extra time and materials necessary for installation of the backer rod and finishing caulk layer can add considerably to the costs and duration of the construction.

SUMMARY OF THE INVENTION

It is an object of the invention to provide an expansion/control joint used to relieve stress and limit or control cracking in a stucco or plaster wall or surface caused by stucco or plaster shrinkage and thermal movement in the stucco or plaster wall or surface.

It is another object of the invention to provide an expansion/control joint that eliminates the need for installation of a backer rod—saving considerable time and money—and significantly cuts down on the potential for leaks between adjacent stucco or plaster surfaces.

Another object of the invention is to provide a system for quick, efficient and lower cost installation of stucco and/or plaster.

These and other objects are provided by my invention, a description of which is set out below.

DETAILED DESCRIPTION

Figure 1:
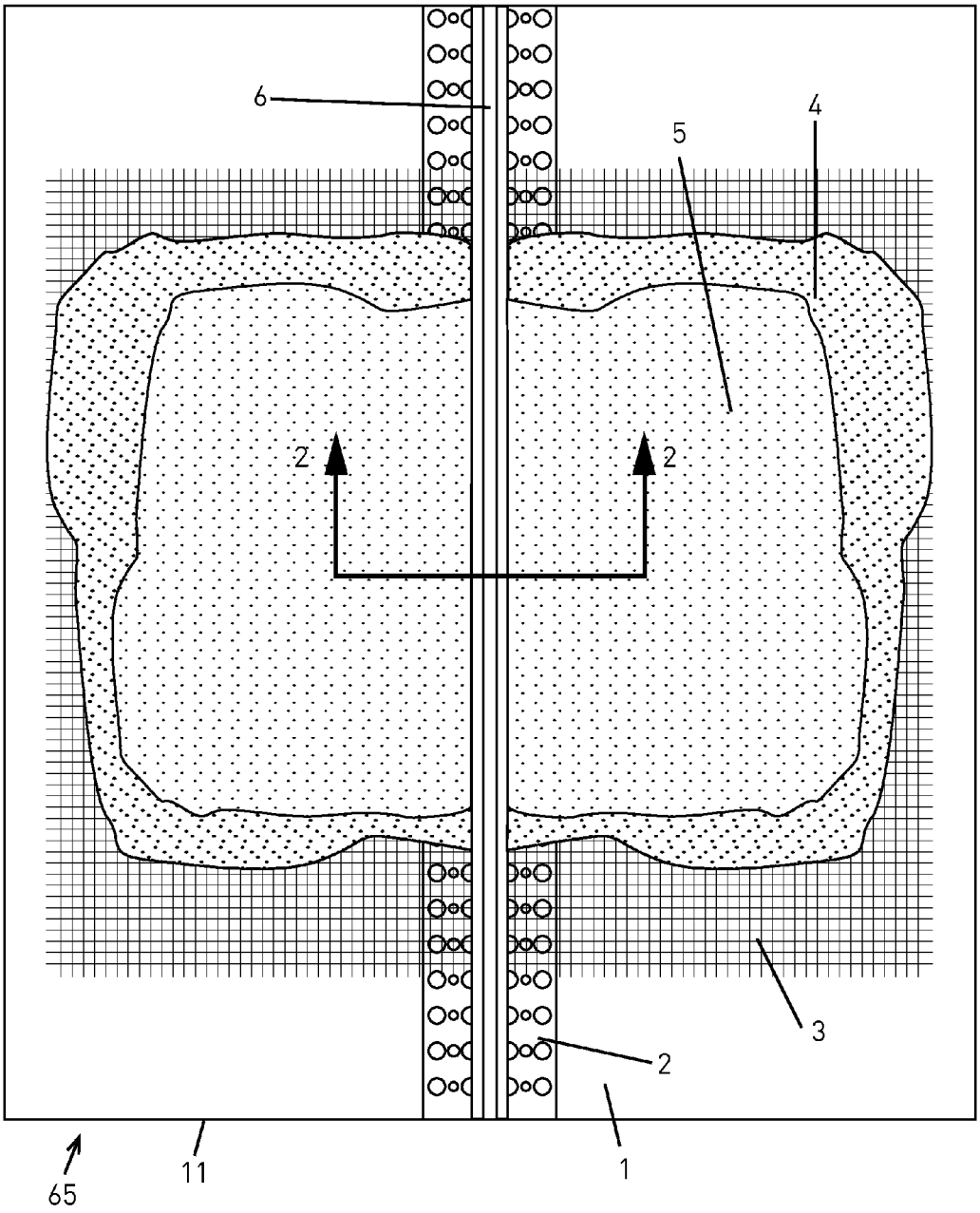
FIG. 1 illustrates in part the typical manner in which stucco or plaster is applied and installed in homes or other buildings onto a wall. However, instead of using an expansion/control joint that comprises two plaster stops mounted adjacent to each about ¼ inch apart forming a gap therebetween, with the gap being filled with a backer rod and a finishing layer of caulk, an expansion/control joint 2 constructed in accordance with the invention is used. Such construction occurs in layers. A wire mesh layer 3 of galvanized wire is anchored over felt paper 1 to a backing wall 11 (usually plywood or a similar material). Scratch coats 4 of plaster or stucco and finish coats 5 of plaster or stucco are applied to the wire layer 3. To relieve stress and limit or control cracking in the stucco or plaster wall or surface, expansion/control joints typically are provided in the stucco or plaster wall or surface every 144 square feet of the stucco or plaster wall or surface. Inventive expansion/control joints 2 are nailed to the backing wall or surface 11 over, behind, or adjacent to the galvanized wire layer 3 where it is desired to position the expansion/control joint 2 (typically at locations in the stucco or plaster wall or surface such that the sub-portions of the stucco or plaster wall or surface formed by the expansion/control joints dividing the wall or surface into sub-portions have an area of 144 square feet or less). No backing rod is necessary. A final small thin layer 6 of caulk is applied to finish the job.
Figure 2:
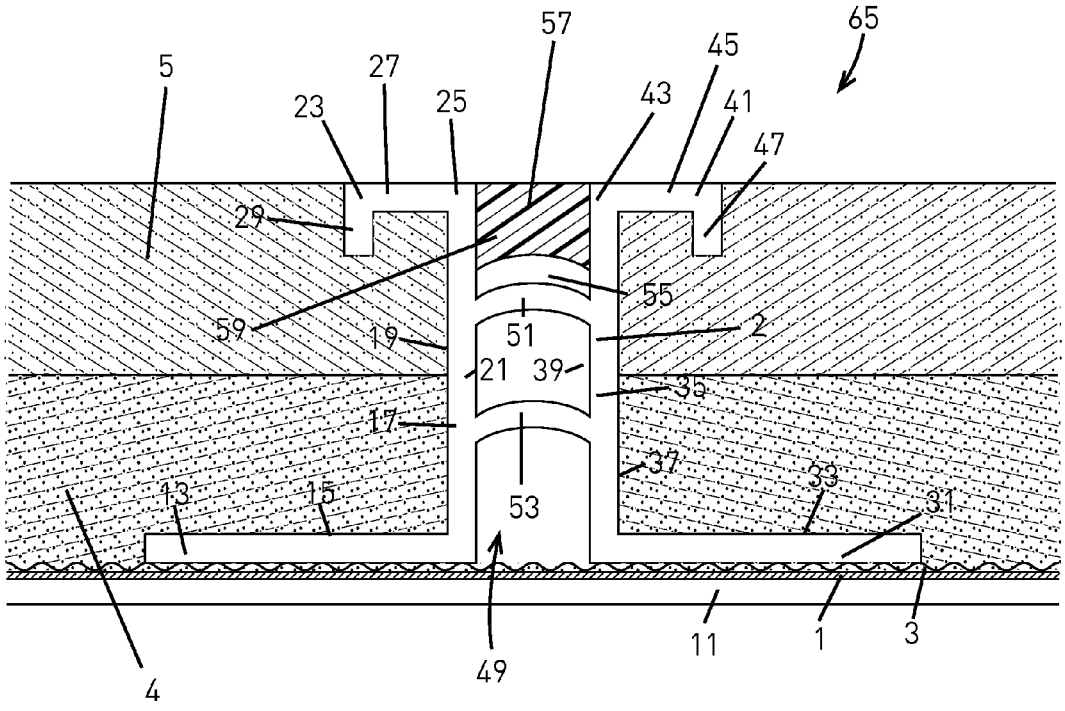
FIG. 2 is a view in cross-section taken along the lines and arrows 2-2, illustrating the inventive expansion/control joint 2 installed in a stucco or plaster wall or surface.
Figure 3:
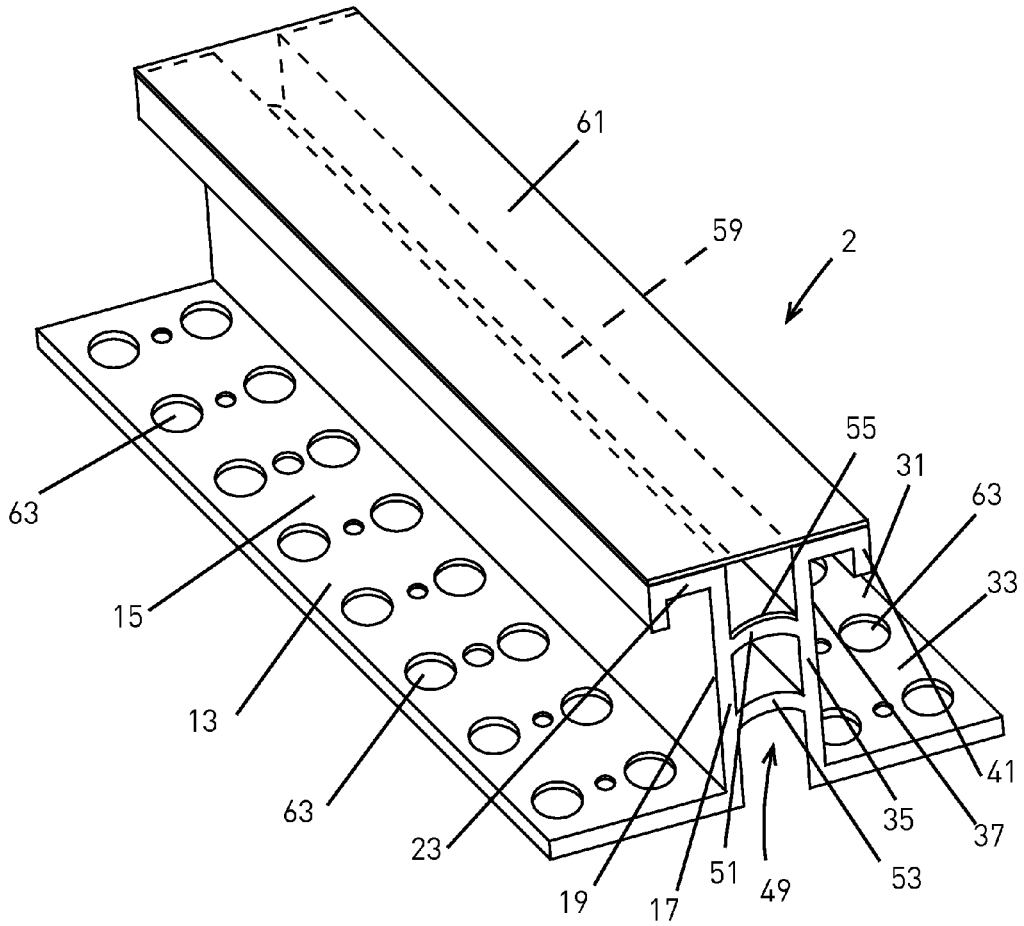
FIG. 3 is a view in perspective of my new expansion/control joint 2 prior to being installed onto the stucco or plaster wall or surface. The base panels 13 and 31, which preferably have perforations 63 formed therein, are nailed or otherwise attached to the backing wall 11. The two higher lip parts of the joint 2 contain the stucco or plaster. The expansion member 49 of the expansion/control joint 2 eliminates the need for a backer rod, thereby cutting down on both leaks and installation time.
Figure 4:
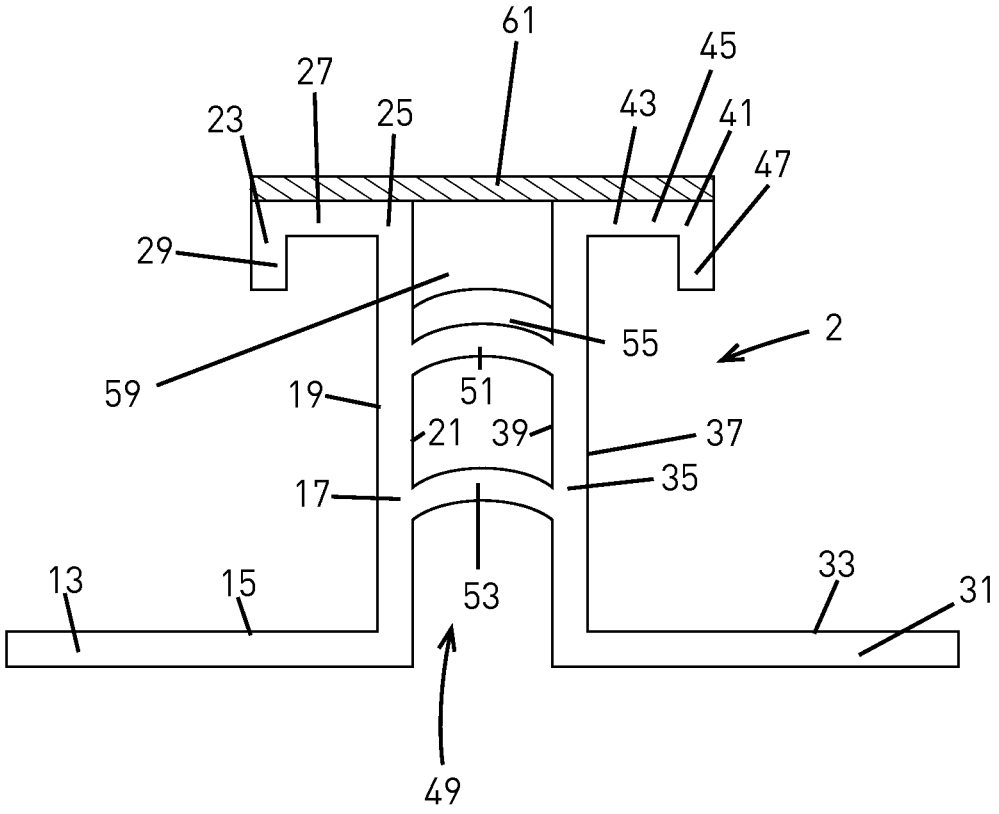
FIG. 4 is a view in elevation of the expansion/control joint 2 shown in FIG. 3.

Turning to the drawings, there is shown a preferred embodiment of my inventive expansion/control joint 2 for stucco or plaster walls or surfaces. In the preferred embodiment shown in the drawings, my inventive expansion/control joint 2 includes a first base panel 13 having a front face 15 over which plaster or stucco material 4, 5 is applied after the expansion/control joint 2 is mounted in place on the backing wall or surface 11. A stucco stop wall 17 is formed on the first base panel 13 and extends outwardly above the front face 15 of the first base panel 13, and the stucco stop wall 17 has a first side 19 and a second side 21. The first side 19 of the stucco stop wall 17 has an engaging surface for engaging plaster or stucco material. Preferably the stucco stop wall 17 has a flange or return 23 formed on its upper end portion 25 to assist in containing plaster or stucco, with the flange 23 having a first portion 27 that extends laterally away from the stucco stop wall 17 and over the first base panel 13 and a second portion 29 extending from the first portion 27 downwardly toward the first base panel 13.

In the preferred embodiment of the invention shown in the drawings, my inventive expansion/control joint 2 also includes a second base panel 31 having a front face 33 over which plaster or stucco material 4,5 is applied after the expansion/control joint 2 is mounted in place on the backing wall or surface 11. A stucco stop wall 35 is formed on the second base panel 31 and extends outwardly above the front face 33 of the second base panel 31, and the stucco stop wall 35 has a first side 37 and a second side 39. The first side 37 of the stucco stop wall 35 has an engaging surface for engaging plaster or stucco material. Preferably, the stucco stop wall 35 has a flange or return 41 formed on its upper end portion 43 to assist in containing plaster or stucco, with the flange 41 having a first portion 45 that extends laterally away from the stucco stop wall 35 and over the second base panel 31 and a second portion 47 extending from the first portion 45 downwardly toward the second base panel 31.

My inventive expansion/control joint 2 also includes an expansion/contraction member 49 extending between the second side 21 of the stucco stop wall 17 of the first base panel 13 and the second side 39 of the stucco stop wall 35 of the second base panel 31 for relieving stress and limiting or controlling cracking in stucco or plaster walls or surfaces. Preferably, the expansion/contraction member 49 comprises two panels 51 and 53 extending between the second sides 21 and 39 of the stucco stop walls 17 and 35 forming a hollow tube extending along and between the stucco stop walls 17 and 35, and preferably, the each panel 51 and 53 bowes slightly upwardly such that force place thereon due to expansion of the stucco or plaster wall or surface facilitates flexing of the panels 51 and 53 to permit the two stucco stop walls 17 and 35 to move closer to each other in response to expansion forces placed on the expansion/control joint 2 by the stucco or plaster walls or surfaces in contact with the expansion/control joint 2, and such that force placed thereon due to contraction of the stucco or plaster wall or surface tends to straighten the panels 51 and 53 to permit the two stucco stop walls 17 and 35 to move away from each other in response to contraction forces placed on the expansion/control joint 2 by the stucco or plaster walls or surfaces in contact with the expansion/control joint 2. Preferably, the expansion/contraction member 49 is comprised of a flexible (and also preferably resilient) material (e.g., a plastic or a polymer such as flexible vinyl (preferably a flexible exterior grade vinyl; or a metal)) and may be formed by co-extruding the expansion/contraction member 49 with the remainder (which comprises a material that is compatible for co-extrusion with the material that is used for the base panels 13 and 31 and the stucco stop walls 17 and 35, such as a rigid exterior grade vinyl which is compatible with a flexible exterior grade vinyl if a flexible exterior grade vinyl is used for the expansion/contraction member 49, or a rigid metal with a flexible metal compatible to the rigid metal if a flexible metal is used for the expansion/contraction member 49. Also, the expansion/control joint 2 preferably is extruded as one piece.

Also, preferably, a strip of bond-breaking tape 55 is affixed to the upper surface of the upper panel 51, to hinder caulk 6 that is applied in the channel 59 between the two second sides 21 and 39 of the stucco stop walls 17 and 35 from bonding to the upper surface of the upper panel 51, such that the caulk 6 adheres only to the two opposing second sides 21 and 39 of the two stucco stop walls 17 and 35 and not to the upper panel 51. The bond-breaking tape 55 hinders formation of a bond between the caulk 6 and the bond-breaking tape 55.

Also, preferably, a strip of removable tape 61 is applied to the upper end portions 25 and 43 of the stucco stop walls 17 and 35 such that the removable tape covers the channel 59 between the two stucco stop walls 17 and 35 to prevent dirt, and stucco or plaster, and the like from entering the channel 59 during installation of the stucco or plaster. After installation of the stucco or plaster, the tape 61 may be peeled from the upper end portions 25 and 43 of the stucco stop walls 17 and 35 to permit caulk 6 (typically a simple and thin layer of caulk 6) to be placed within the channel 59 to complete installation. With the bond-breaking tape 55 in place on the upper surface of the upper panel 51, the caulk 6 positioned within the channel 59 to complete installation of the expansion/control joint 2 on a stucco or plaster wall or surface bonds only with the adjacent second sides 21 and 39 of the stucco stop walls 17 and 35, thereby creating a double-sided joint (e.g., caulk 6 connected only to the adjacent sides 21 and 39 of the stucco stop walls 17 and 35), rather than a triple-sided joint (e.g., caulk 6 connected to the adjacent sides 21 and 39 of the stucco stop walls 17 and 35 and to the upper surface of the upper panel 51). Also, preferably, each first and second base panel 13 and 31 is provided with perforations 63.

Preferably, the expansion/control joint 2 is about 4 inches wide and about ¾ inches high (at the top of the stucco stop walls 17 and 35), and the width of the expansion/contraction member 49 preferably is ¼ inch to ½ inch and more preferably ⅜ inch. Also, the distance from the top of the expansion/contraction member 49 to the top of the stucco stop walls 17 and 35 preferably is ¼ inch.

During the extrusion process used during manufacturing of the inventive expansion/control joint 2, preferably the bond-breaking tape 55 and the removable strip of tape 61 are applied to the expansion/control joint 2 as the expansion/control joint 2 exits the extruder.

My invention also includes a stucco or plaster wall or surface 65 having an expansion/control joint 2 mounted therein to separate the stucco or plaster wall or surface 65 into sub-portions typically having an area of 144 square feet or less, and caulk 6 positioned in the channel 59 of the expansion/control joint 2 and contacting the adjacent second sides 21 and 39 of the stucco stop walls 17 and 35 to form a seal therebetween. Preferably, the expansion/control joint 2 is provided with bond-breaking tape 55 mounted on the upper surface of the upper panel 51 of the expansion/contraction member 49 of the expansion/control joint 2.

In use, preferably the inventive expansion/control joint 2 is mounted to a backing wall or surface 11 (e.g., plywood) over, behind, or adjacent to a wire mesh layer 3 of galvanized wire which is anchored to the backing wall or surface 11 over felt paper 1. Plaster or stucco material 4, 5 is applied to the wall or surface 11 and kept separate into sub-portions typically having an area of 144 square feet or less by one or more expansion/control joints 2. Caulk 6 is applied in the channel 59 of the expansion/control joint 2 to seal between adjacent second sides 21 and 39 of the stucco stop walls 17 and 35 of the expansion/control joint 2 and to provide a neat finish.

Because the expansion/contraction member 49 of the expansion/control joint 2 is flexible and preferably resilient, it permits the stucco or plaster wall or surface 65 to expand and contract, thereby relieving stress and limiting or controlling cracking in the stucco or plaster wall or surface 65 caused by stucco or plaster shrinkage and thermal movement in the stucco or plaster wall or surface 65.

What is claimed is:

1. An expansion/control joint used to separate stucco or plaster material during application of the stucco or plaster material to a wall into sub-portions, and to relieve stress and limit or control cracking in a stucco or plaster wall or surface caused by stucco or plaster shrinkage and thermal movement in the stucco or plaster wall or surface, comprising a first base panel having a front face, a first stucco stop wall formed on the first base panel and extending outwardly above the front face of the first base panel, the first stucco stop wall having a first side and a second side, the first side of the first stucco stop wall having an engaging surface for engaging plaster or stucco material, a second base panel having a front face, a second stucco stop wall formed on the second base panel and extending outwardly above the front face of the second base panel, the second stucco stop wall having a first side and a second side, the first side of the second stucco stop wall having an engaging surface for engaging plaster or stucco material, an expansion/contraction member extending between the second side of the first stucco stop wall of the first base panel and the second side of the second stucco stop wall of the second base panel for relieving stress and controlling cracks in stucco or plaster surfaces, the expansion/contraction member being flexible to permit movement of the expansion/contraction member responsive to weather induced movement of the stucco or plaster material, the expansion/contraction member comprising two flexible panels extending between the second sides of the first and second stucco stop walls, the two panels comprising an upper panel and a lower panel, the panels forming in conjunction with the second sides of the first and second stucco stop walls a flexible hollow tube extending along and between the second sides of the first and second stucco stop walls which flexes to accommodate expansion and contraction of the stucco or plaster material, a caulk receiving area formed between the second sides of the first and second stucco stop walls and above the upper panel of the expansion/contraction member for receiving caulk, the upper panel of the expansion/contraction member having an upper end portion having an outer surface, and bond-breaking tape mounted on the outer surface of the upper end portion of the upper panel of the expansion/contraction member the first stucco stop wall having an upper end portion and a flange formed in its upper end portion to assist in containing stucco or plaster material, the flange extending laterally away from the first stucco stop wall and over the first base panel, and the flange of the first stucco stop wall having an upper outer surface, the second stucco stop wall having an upper end portion and a flange formed in its upper end portion to assist in containing stucco or plaster material, the flange extending laterally away from the second stucco stop wall and over the second base panel, and the flange of the second stucco stop wall having an upper outer surface, and further including a strip of removable tape applied to the upper outer surface of the flange of the first stucco stop wall and to the upper outer surface of the flange of the second stucco stop wall and extending over the channel between the first and second stucco stop walls such that the removable tape covers the channel between the first and second stucco stop walls to prevent dirt, stucco, plaster, and the like from entering the channel during installation of the stucco or plaster material.

2. The expansion/contraction joint of claim 1, the upper panel of the expansion/contraction member being bowed.

3. The expansion/control joint of claim 1, the lower panel of the expansion/contraction member being bowed.

4. The expansion/control joint of claim 1, the upper and lower panels of the expansion/contraction member being bowed.

5. The expansion/control joint of claim 1, the first base panel having perforations formed therein.

6. The expansion/control joint of claim 1, the second base panel having perforations therein.

7. The expansion/control joint of claim 1, the first stucco stop wall having an upper end portion, and the first stucco stop wall having a flange formed in its upper end portion to assist in containing stucco or plaster material, the flange having a first portion that extends laterally away from the first stucco stop wall and over the first base panel and a second portion extending from the first portion downwardly toward the first base panel.

8. The expansion/control joint of claim 1, the second stucco stop wall having an upper end portion, and the second stucco stop wall having a flange formed in its upper end portion to assist in containing stucco or plaster material, the flange having a first portion that extends laterally away from the second stucco stop wall and over the second base panel and a second portion extending from the first portion downwardly toward the second base panel.

9. A method of relieving stress and limiting or controlling cracking in a stucco or plaster wall or surface caused by stucco or plaster shrinkage and thermal movement in the stucco or plaster wall or surface, comprising the steps of providing the expansion/control joint of claim 1, mounting the expansion/control joint on a backing wall, applying stucco or plaster material to the backing wall over the first and second base panels of the expansion/control joint, and up against the engaging surfaces of the first surfaces of the first and second stucco stop walls of the expansion/control joint, keeping the stucco or plaster material separated into sub-portions on the stucco or plaster wall or surface by being divided into sub-portions on the stucco or plaster wall or surface by the expansion/control joint, sealing against leaks by applying caulk to and extending between the second sides of the first and second stucco stop walls over the upper panel of the expansion/contraction member to form a seal between the second sides of the first and second stucco stop walls, and the expansion/contraction member of the expansion control joint flexing to accommodate expansion and contraction of the stucco or plaster material.

* * * * *